US007229331B2

(12) United States Patent
Norman et al.

(10) Patent No.: US 7,229,331 B2
(45) Date of Patent: Jun. 12, 2007

(54) SHROUD FOR A HYDRO THRUST DEVICE

(75) Inventors: George I. Norman, Salt Lake City, UT (US); Thomas W. Peterson, Taylorville, UT (US)

(73) Assignee: Enviroprop Corporation, Sarasota, FL (US)

( * ) Notice: Subject to any disclaimer, the term of this patent is extended or adjusted under 35 U.S.C. 154(b) by 0 days.

(21) Appl. No.: 11/337,436

(22) Filed: Jan. 23, 2006

(65) Prior Publication Data

US 2006/0166571 A1 Jul. 27, 2006

Related U.S. Application Data

(60) Provisional application No. 60/646,330, filed on Jan. 24, 2005.

(51) Int. Cl.
*B63H 5/16* (2006.01)

(52) U.S. Cl. ..... 440/71; 440/66

(58) Field of Classification Search ..... 440/6, 440/66, 67, 70, 71, 72, 76
See application file for complete search history.

(56) References Cited

U.S. PATENT DOCUMENTS

| | | | | |
|---|---|---|---|---|
| 116,513 | A | 6/1871 | Tripler | |
| 573,351 | A | 12/1896 | Parker | |
| 1,092,960 | A | 4/1914 | Taylor | |
| 1,620,129 | A | 3/1927 | Peterson | |
| 2,030,375 | A | 2/1936 | Kort | 115/42 |
| 2,091,677 | A | 8/1937 | Fredericks | 170/170 |
| 2,124,497 | A | 7/1938 | Slauson | 114/219 |
| 2,139,594 | A | 12/1938 | Kort | |
| 2,275,618 | A | 3/1942 | Edwards | 115/11 |
| 2,355,842 | A | 8/1944 | Arado | 115/40 |
| 2,444,217 | A | 6/1948 | Armentrout | 99/68 |
| 2,551,371 | A | 5/1951 | Grigg | |
| 3,112,610 | A | 12/1963 | Jerger | 60/35.5 |
| 3,249,083 | A | 5/1966 | Irgens | 115/12 |
| 3,314,392 | A | 4/1967 | Molas et al. | 115/18 |
| 3,455,268 | A | 7/1969 | Gordon | 114/166 |
| 3,508,517 | A | 4/1970 | Hannan | 115/42 |
| 3,675,424 | A | 7/1972 | Oosterveld | 60/221 |
| 3,802,377 | A * | 4/1974 | Porter et al. | 440/72 |
| 3,805,723 | A | 4/1974 | Bernaerts | 114/16 R |
| 3,889,624 | A | 6/1975 | Balius | 115/42 |
| 4,013,033 | A * | 3/1977 | Porter et al. | 440/72 |
| 4,078,516 | A | 3/1978 | Balius | 115/42 |
| 4,106,425 | A | 8/1978 | Gruber | 115/42 |
| 4,304,558 | A | 12/1981 | Holtermann | 440/67 |
| 4,411,631 | A | 10/1983 | Makinen | 440/72 |

(Continued)

FOREIGN PATENT DOCUMENTS

| | | |
|---|---|---|
| FR | 2658781 | 2/1990 |

*Primary Examiner*—Lars A. Olson
(74) *Attorney, Agent, or Firm*—Kunzler & Associates

(57) ABSTRACT

An apparatus is disclosed for improving safety and hydro-flow thrust from a trolling motor. The apparatus may include a first and second semi-circular portions configured to connect together to substantially enclose a hydro-drive device, and a semi-circular bracket coupled to each semi-circular portion, the semi-circular brackets together capable of fixedly coupling the first and second semi-circular portions to a trolling motor housing. The apparatus may also include an annular portion configured to couple to an aft opening formed by the first and second semi-circular portions.

19 Claims, 18 Drawing Sheets

U.S. PATENT DOCUMENTS

| | | | | |
|---|---|---|---|---|
| 4,427,393 | A | 1/1984 | May | 440/67 |
| 4,565,533 | A | 1/1986 | Springer | 440/71 |
| 4,600,394 | A | 7/1986 | Dritz | 440/38 |
| 4,637,801 | A | 1/1987 | Schultz | 440/67 |
| 4,694,645 | A | 9/1987 | Flyborg et al. | 60/221 |
| 4,776,755 | A | 10/1988 | Bjorkestam et al. | 415/121 G |
| 4,826,461 | A | 5/1989 | Newman | 440/71 |
| 4,832,634 | A | 5/1989 | Kearns | 440/67 |
| 4,957,459 | A | 9/1990 | Snyder | 440/72 |
| 5,009,620 | A | 4/1991 | Feranda, Sr. | 440/72 |
| 5,078,516 | A | 1/1992 | Kapon et al. | 385/129 |
| 5,145,428 | A | 9/1992 | Harrison | 440/89 |
| 5,292,088 | A | 3/1994 | Lemont | 244/65 |
| 5,389,021 | A | 2/1995 | Padgett | 440/67 |
| 5,501,622 | A * | 3/1996 | Phelan | 440/71 |
| 5,651,707 | A | 7/1997 | Lemont | 440/67 |
| 5,846,103 | A | 12/1998 | Varney et al. | 440/38 |
| 5,848,922 | A | 12/1998 | Itima et al. | 440/66 |
| 5,964,626 | A | 10/1999 | Varney et al. | 440/38 |
| 6,059,618 | A | 5/2000 | Purnett et al. | 440/38 |
| 6,475,045 | B2 | 11/2002 | Schultz et al. | 440/71 |
| 6,846,210 | B1 | 1/2005 | Abella | 440/67 |
| 2003/0104733 | A1 | 6/2003 | Ishigaki et al. | 440/71 |

* cited by examiner

SHROUD FOR A HYDRO THRUST DEVICE

CROSS-REFERENCES TO RELATED APPLICATIONS

This application claims benefit of U.S. Provisional Patent Application No. 60/646,330 entitled "ENVIROPROP VELOCITYGUARD," filed on Jan. 24, 2005 for George I. Norman, which is incorporated herein by reference.

BACKGROUND OF THE INVENTION

1. Field of the Invention

This invention relates to marine propulsion devices such as trolling motors, outboard motors, stem drive units and the like, and more particularly relates to improving safety and hydro-flow thrust from hydro-drive devices.

2. Description of the Related Art

For over 100 years screwdriven propellers and impellers have been used to propel marine vehicles. Over the years, the technology of the propulsion drives has changed incredibly. However, the technology of the propeller/impeller, aside from sizes and shapes, has remained relatively unchanged.

As a propeller/impeller turns, water is drawn in and is accelerated through the flywheel action of a propeller/impeller increasing the higher-velocity stream of water behind (aft) the propeller/impeller. Accelerating the water by the action of pulling water in and pushing water out at a higher velocity is commonly known as adding momentum to the water. This change in momentum or acceleration of the water (hydro-flow) results in a force called "thrust." A curvature of the propeller/impeller blade creates low-pressure on the back of the blade, thus inducing lift, much like the wing on an airplane. With a marine propeller/impeller, the lift is translated into horizontal movement.

The spinning blades of the propeller/impeller produce hydro-flow thrust, which can depend upon many factors. Examples of such factors include volume of water accelerated per time unit, propeller/impeller diameter, velocity of incoming hydro-flow, density of water, and the SHP (shaft horsepower) accelerating the propeller/impeller. As in any motorized industry, great expense and effort is put into the improvement of efficiency and power of the motor. Perhaps the largest factor relating to efficiency and power or hydro-flow thrust is the propeller/impeller.

The propeller shroud also has the additional benefit of protecting submerged objects from contact with the propeller/impeller. With ever increasing marine vehicle ownership, incidents of injury or damage due to propeller/impellers strikes, though unfortunate, seem commonplace. The shroud prevents swimmers, water skiers, water sports enthusiast, and marine life from encountering or being entangled by the spinning blades of a propeller/impeller. Safety is accomplished by enclosing the entire flywheel area of the propeller/impeller within the propeller shroud.

Shrouds are available that may perform the function of protecting people, marine sea and plant life from the propeller/impeller. However, available shrouds tend to restrict water flow, increase drag, or modify the exiting water stream. Each of the aforementioned actions appreciably reduces hydro-flow thrust, thus negatively affecting the performance.

From the foregoing discussion, it should be apparent that a need exists for an apparatus that protects people, marine and plant life, and increases hydro-flow thrust generated from a boat propeller/impeller. Beneficially, such a system and apparatus would increase hydro-flow, decrease drag, and improve performance by increasing the volume and velocity of hydro-flow thrust in a vortex exiting the shroud

SUMMARY OF THE INVENTION

The present invention has been developed in response to the present state of the art, and in particular, in response to the problems and needs in the art that have not yet been fully solved by currently available hydro-drive device thrust enhancement systems. Accordingly, the present invention has been developed to provide a system and apparatus for improving thrust from a hydro-drive device that overcome many or all of the above-discussed shortcomings in the art.

The apparatus to improve thrust may include first and second semi-circular portions configured to connect together to substantially enclose a hydro-drive device, and a semi-circular bracket coupled to each semi-circular portion, the semi-circular brackets together capable of fixedly coupling the first and second semi-circular portions to a trolling motor housing. The apparatus may include an annular portion configured to couple to an aft opening formed by the first and second semi-circular portions.

In one embodiment, the apparatus also includes a plurality of flanges extending outward laterally therefrom, each flange configured to engage a surface of a flange of an opposing semi-circular portion, and a plurality of clips configured to securely engage a plurality of opposing flanges and maintain the position of the flanges relative to one another.

The apparatus may also include support braces configured to stabilize the flow of water exiting the trolling motor shroud. In a further embodiment, the first and second semi-circular portions are identical. Additionally, the first and second semi-circular portions may each comprise a cut-out portion for receiving a skeg. The cut-out portion may comprise a plurality of cut-out regions configured to receive skegs of varying sizes.

In one embodiment, the annular portion is configured to couple to the aft opening by screwing onto the first and second semi-circular portions and to partially secure the first and second semi-circular portions. The apparatus may also include at least one shim for decreasing the diameter of the semi-circular bracket in order to engage smaller diameter trolling motor housings.

Reference throughout this specification to features, advantages, or similar language does not imply that all of the features and advantages that may be realized with the present invention, should be, or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are given to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1:
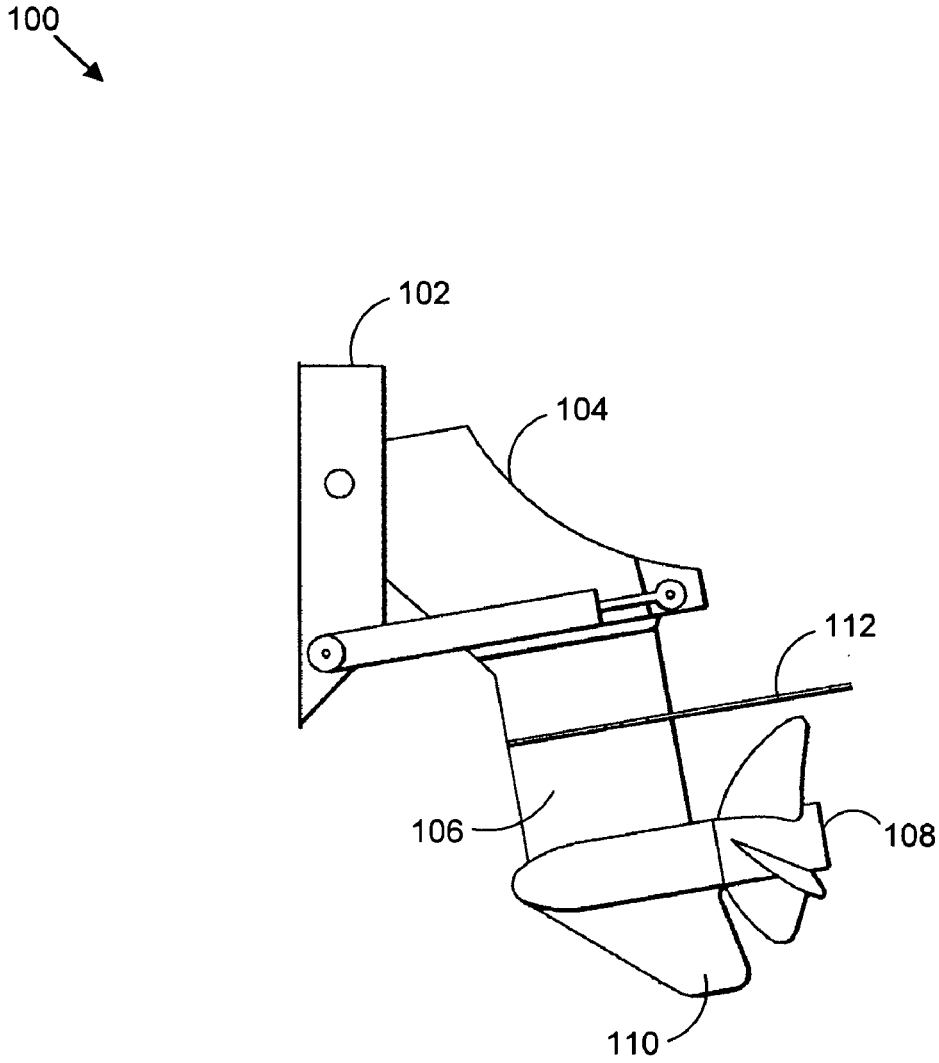
FIG. 1 (Prior Art)
FIG. 1 is a side view of one embodiment of a system for moving a marine vehicle in accordance with the prior art.

FIG. 1 is a side view of one embodiment of a system 100 for moving a marine vehicle in accordance with the prior art. The system 100 may include a transom mount assembly 102 for connecting the system 100 to a stem or transom of a boat (not shown). The transom mount assembly 102 is configured to transfer power from a motor to an upper gear case assembly 104. The upper gear case assembly 104 directs the power through a drive shaft (not shown) to the lower unit 106 and in turn to a hydro-drive device 108. The system 100 may also include a skeg 110 and a cavitation plate 112 (also referred to as "anticavitation plate" or "antiventillation plate"). The cavitation plate 112 prevents surface air from reaching the hydro-drive device 108.

Figure 2:
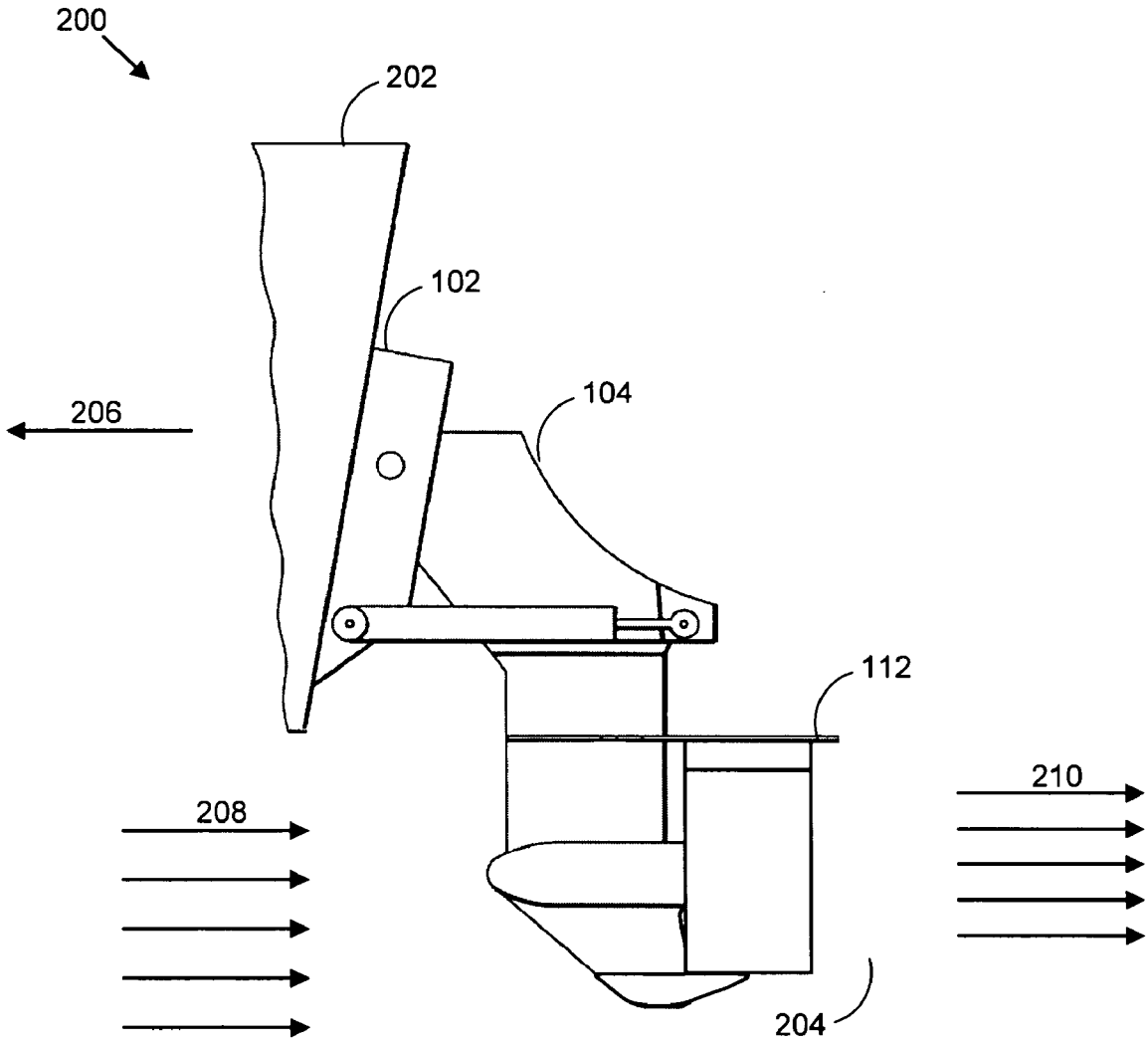
FIG. 2 is a partially schematic side view diagram graphically illustrating one embodiment of a system for moving a marine vehicle in accordance with the present invention.

FIG. 2 is a partially schematic side view diagram graphically illustrating one embodiment of a system 200 for moving a marine vehicle in accordance with the present invention. The system 200 may include the stem of the boat 202 connected to the transom mount assembly 102 as described above with reference to FIG. 1. Additionally, the system 200 may comprise a shroud 204 configured to at least partially enclose the hydro-drive device. In one embodiment, the shroud 204 is coupled to the cavitation plate 112 and the skeg 110. As used herein, the term "shroud" refers to a substantially cylindrical device for at least partially circumferentially enclosing the hydro-drive device 108. The shroud 204 is formed from a substantially solid side wall around the hydro-drive device 108. The side wall protects the hydro-drive device 108 and directs the flow of water from the hydro-drive device 108 as will be described below.

The depicted embodiment illustrates the shroud 204 coupled to a stem-drive system. Alternatively, the shroud 204 may be similarly coupled to outboard motor assemblies, inboard motor assemblies,jet propelled vehicles such as personal water craft, and other marine drive assemblies having hydro-drive devices 108. As used herein, the term "hydro-drive device" refers to any marine vehicle thrust inducing device such as, but not limited to, propellers, impellers, and the like.

Figure 3:
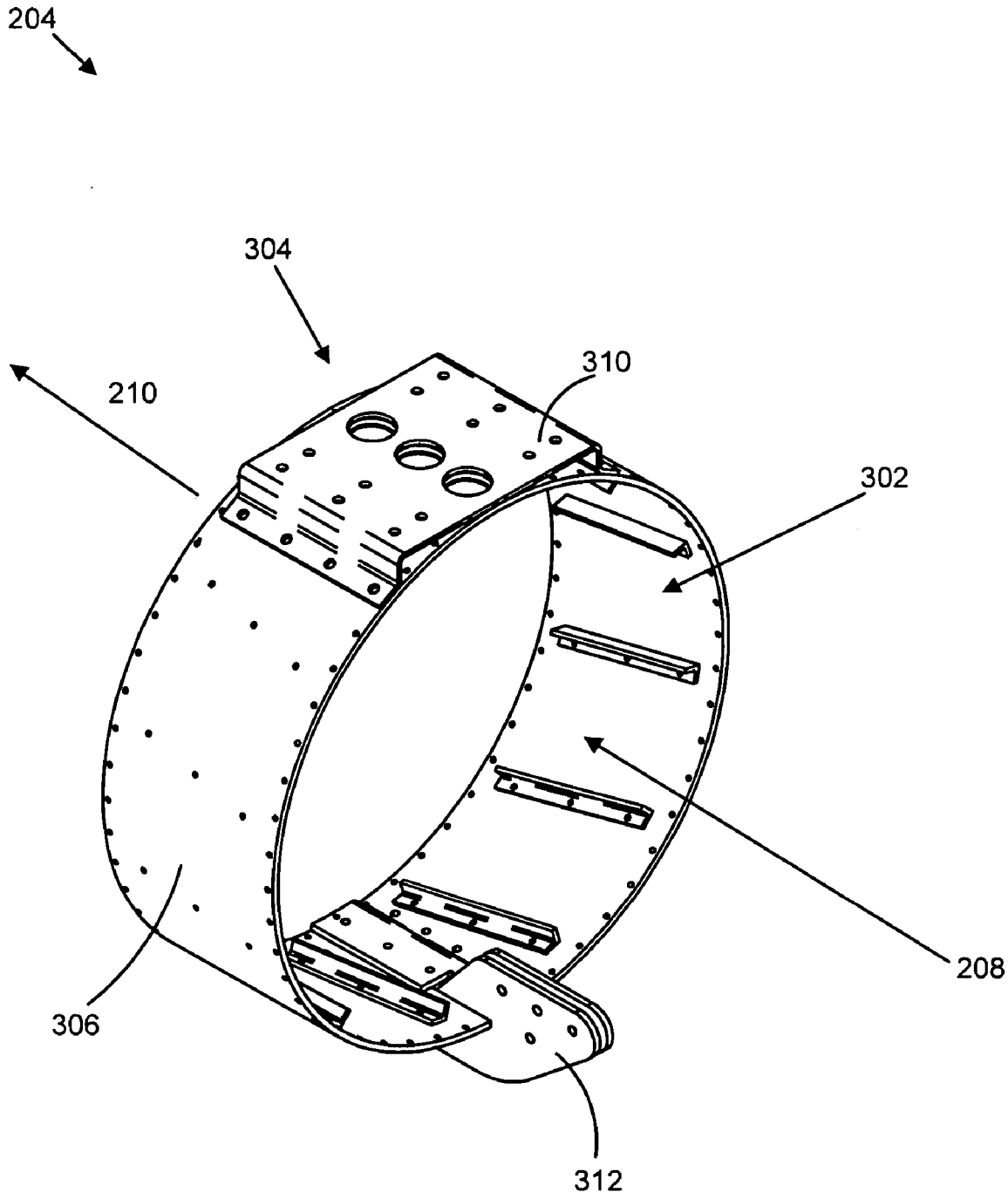
FIG. 3 is a perspective view shown from the top and to one side and illustrating one embodiment of the shroud in accordance with the present invention.

The system 200 is configured to enable the boat 202 to move about in water. The boat 202 may move in both a forward direction represented by arrow 206 and a reverse direction. The gear case assembly 104 is mounted for pivotal movement about a vertical axis to enable the boat to turn. As the boat 202 moves through water, water enters the shroud 204 in a direction illustrated by arrows 208 and exits in a direction indicated by arrows 210. The shroud 204 may comprise a first opening 302 (shown in FIG. 3) configured to allow the unrestricted ingress of water, and a second opening 304 (shown in FIG. 3) for the egress of FIG. 3 is a perspective view shown from the top and to one side and illustrating one embodiment of the shroud 204 in accordance with the present invention. The shroud 204 may comprise a substantially tubular cylinder having the first opening 302 and the second opening 304. The shroud 204 is configured to at least partially circumferentially enclose the hydro-drive device 108 in a cylindrical region 306. The first opening 302 may have a diameter slightly larger than the hydro-drive device 108 in order to circumferentially enclose the hydro-drive device. The cylindrical region 306 may alternatively completely circumferentially enclose the hydro-drive device 108 thereby protecting swimmers, water skiers, water sports enthusiast, and marine life from encountering or being entangled by the hydro-drive device 108.

The shroud 204 may also include a mounting plate 310 for connecting the shroud 204 to the cavitation plate 112, and a skeg coupler 312 for securing the shroud 204 to the skeg 110. Fastening devices (not shown) may include standard nuts and bolts. Alternatively, a keyed fastening device may be used when connecting the skeg coupler 312 to the skeg 110 in order to prevent theft of the shroud 204 and the hydro-drive device 108.

The shroud 204 may be formed of a light-weight metallic based material such as, but not limited to, aluminum alloys, steel alloys, titanium alloys, or the like. Additionally, the shroud 204 may be formed of composite materials including carbon fiber, high-impact plastics, or fiberglass. Depending upon the material used, the shroud maybe pressed, rolled, injection molded, rotation molded, thermoformed, layed-up, spun, or extruded. Different finishes may also be applied to a surface of the shroud 204 in order to reduce drag and form a protective layer. The shroud 204 may be formed of discrete pieces, each forming a portion of the circumference of the shroud 204 and fastened together by a means such as welding or riveting.

Figure 4:
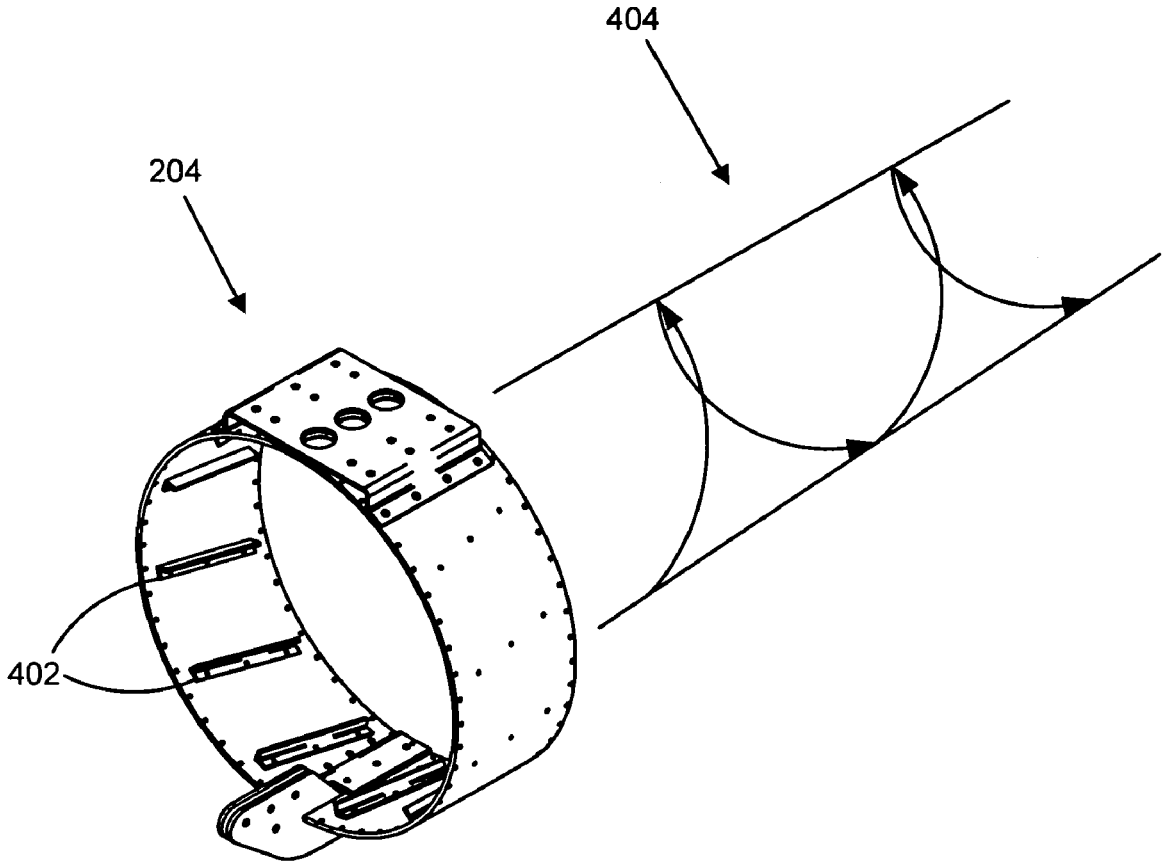
FIG. 4 is a perspective view diagram illustrating one embodiment of the shroud having a plurality of hydroflow vortex diverters for directing fluid to form a vortex 404 as the water exits the shroud in accordance with the present invention.

FIG. 4 is a perspective view diagram illustrating one embodiment of the shroud 204 having a plurality of hydroflow vortex diverters 402 for directing fluid to form a vortex 404 as the water exits the shroud 204. As used herein the term "hydroflow vortex diverter" refers to any device configured to direct water to form a vortex as the water exits the shroud 204 through the second opening 304. The hydroflow vortex diverter (hereinafter "diverter") 402 may comprise a device having a substantially flat surface for directing the flow 404 of water to form a vortex. Examples of diverters 402 may include, but are not limited to, vanes, blades, and/or fins. Alternatively, the shroud 204 may comprise a single diverter 402 for directing fluid to form a vortex 404. As used herein, the term "vortex" refers to fluid flow involving rotation about an axis.

Each diverter 402 may extend inward from an interior surface of the shroud 204, and extend longitudinally towards the second opening 304. Additionally, the diverters 402 are in one embodiment angled in such a way as to induce and/or enhance the vortex 404 formed by the hydro-drive device 108. In an alternative embodiment, the diverters 402 may be configured as grooves or channels (not shown) formed in the interior surface 410 of the shroud 204 and angled to direct water to enhance the vortex 404. The diverter 402 may be riveted, welded, bolted, attached using adhesive, or the like.

In a further embodiment, the diverter 402 may be formed of a ceramic material, composite material, or a high-impact rigid plastic. In one embodiment, the diverter 402 is configured with a curve to direct water to form a vortex as described above with reference to FIG. 4. The diverter 402 may be angled to form counter-clockwise or clockwise vortices depending upon the direction of rotation of the hydro-drive device 108.

Figure 5A:
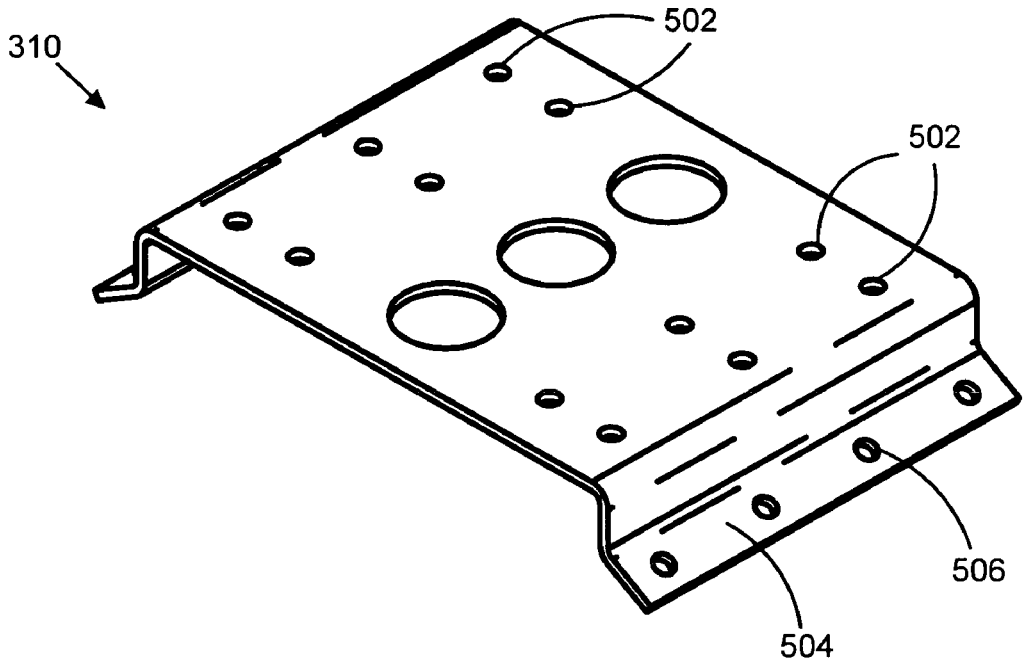
FIG. 5*a* is a side and top perspective view graphically illustrating one embodiment of the mounting plate in accordance with the present invention.

FIG. 5*a* is a side and top perspective view graphically illustrating one embodiment of the mounting plate 310 in accordance with the present invention. In one embodiment, the mounting plate 310 is configured to mount to the cavitation plate 112 of an outboard or stern drive motor housing. The mounting plate 310 is configured with a plurality of holes 502 for receiving fastening devices for coupling the mounting plate 310 to the cavitation plate 112. In a further embodiment, the mounting plate 310 may be configured to engage any flat surface such as a boat bottom, thereby enabling the shroud 204 to be mounted to marine vehicles that do not employ outboard motor housings such as, but not limited to tugboats, cruise ships, ocean cargo ships, and personal water craft.

Tabs 504 may be positioned having an angle sufficient for interfacing with the curvature of the shroud 204. The tabs 504 may be configured with a plurality of holes 506 configured to receive fastening devices. In one embodiment, the fastening devices (not shown) comprise rivets.

Figure 5B:
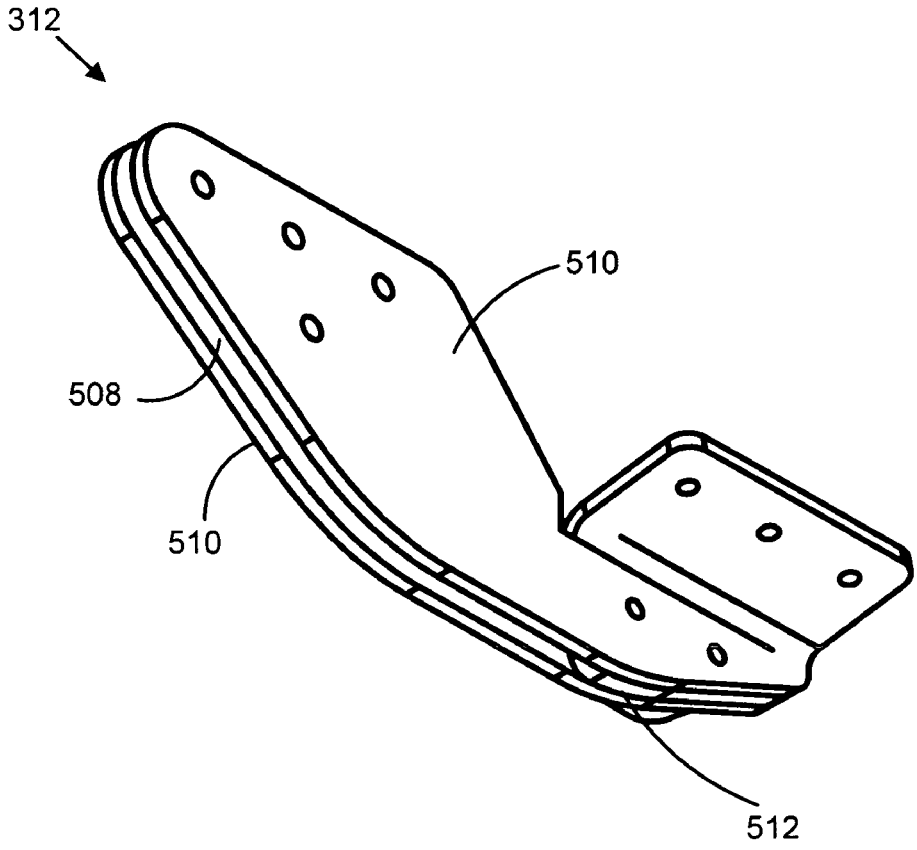
FIG. 5*b* is a bottom and side perspective view diagram illustrating one embodiment of the skeg coupler in accordance with the present invention.

FIG. 5*b* is a bottom and side perspective view diagram illustrating one embodiment of the skeg coupler 312 in accordance with the present invention. In one embodiment, the skeg coupler 312 comprises a slot 508 for receiving the skeg 110 of the outboard system 100. Alternatively, the slot 508 may receive the skeg of non-outboard marine drive systems. Once the skeg coupler 312 has been attached to the skeg 110, a unique fastener, such as a bolt, with a unique key may be locked in place in order to prevent theft of the hydro-drive device 108 or the shroud 204. In one embodiment, the skeg coupler 312 may comprise first and second sections 510 configured to engage a spacer 512. Alternatively, the skeg coupler 312 may be formed as a single unitary device.

Figure 6A:
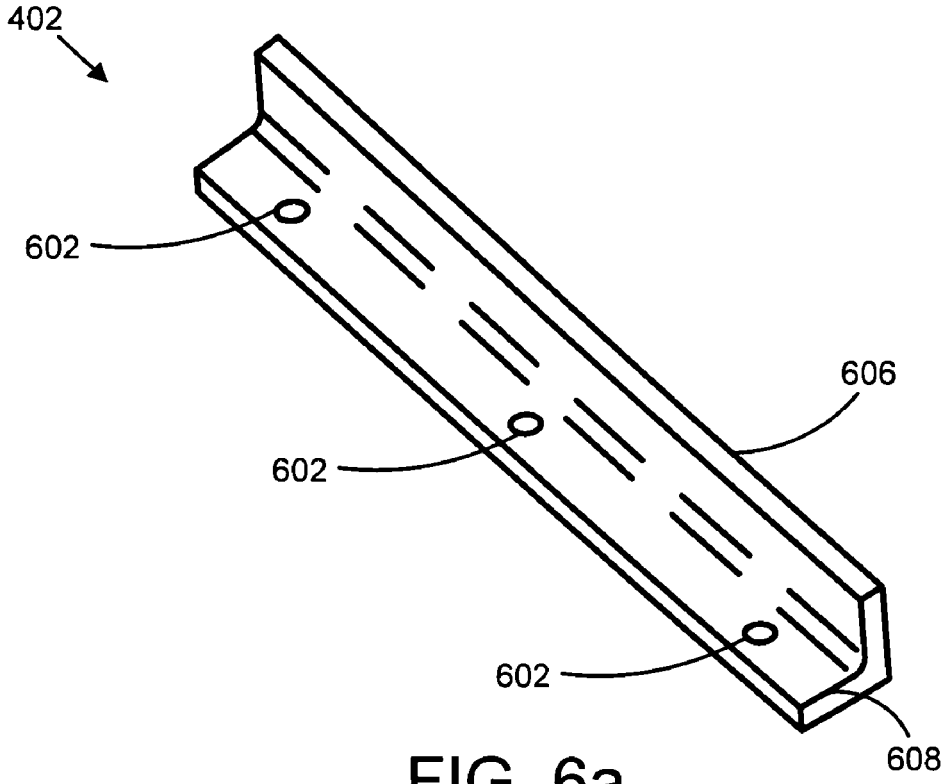
FIG. 6*a* is a perspective view diagram illustrating one embodiment of a diverter in accordance with the present invention.

FIG. 6*a* is a perspective view diagram illustrating one embodiment of a diverter 402 in accordance with the present invention. In one embodiment, the diverter 402 may comprise a length of 'L' shaped material. The diverter 402 may be formed of a metal or rigid plastic. As depicted, the diverter 402 is substantially linear. In an alternative embodiment, the diverter 402 may be formed with a curve substantially similar to the interior curvature of the shroud 204 in order to interface with an interior surface of the shroud 204.

The diverter 402 is configured with a plurality of holes 602 for connecting the diverter 402 with the shroud 204. The diverter 402 may be permanently affixed to the shroud, or alternatively removably coupled with the shroud 204. For example, the diverter 402 may be welded to the shroud 204. Alternatively, the diverter 402 may be riveted to the shroud 204. In a further embodiment, the diverter 402 may be integrally formed with the shroud 204.

Figure 6B:
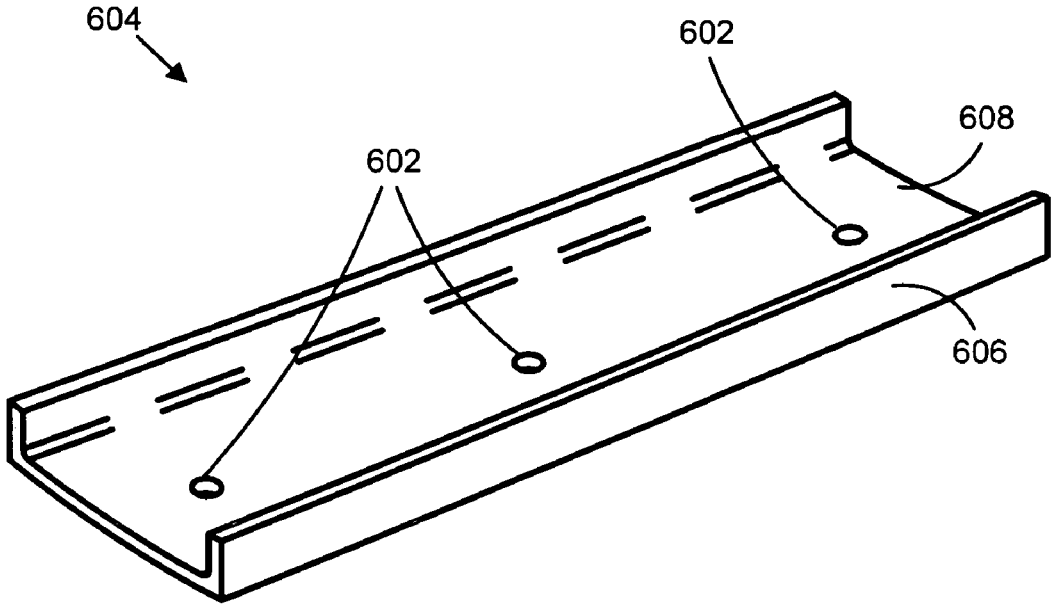
FIG. 6*b* is a perspective view diagram illustrating an alternative embodiment of a diverter in accordance with the present invention.

FIG. 6*b* is a perspective view diagram illustrating an alternative embodiment of a diverter 604 in accordance with the present invention. In one embodiment, the diverter 604 comprises a length of 'u' or 'c' channel. Both the diverter 402 of FIG. 6*a* and the diverter 604 may be configured with a vane 606 extending at a substantially right angle away from a base 608. Alternatively, the vane 606 may extend at an angle selected to optimally direct water to form a vortex. The vane 606 functions as a blade or fin in order to direct water according to the orientation of the diverter 402, 604 with relation to the shroud 204. In one embodiment, a plurality of diverters is arranged in a manner configured to form a clock-wise or alternatively a counter-clockwise vortex, depending upon the direction of rotation of the hydro-drive device 108.

Figure 7:
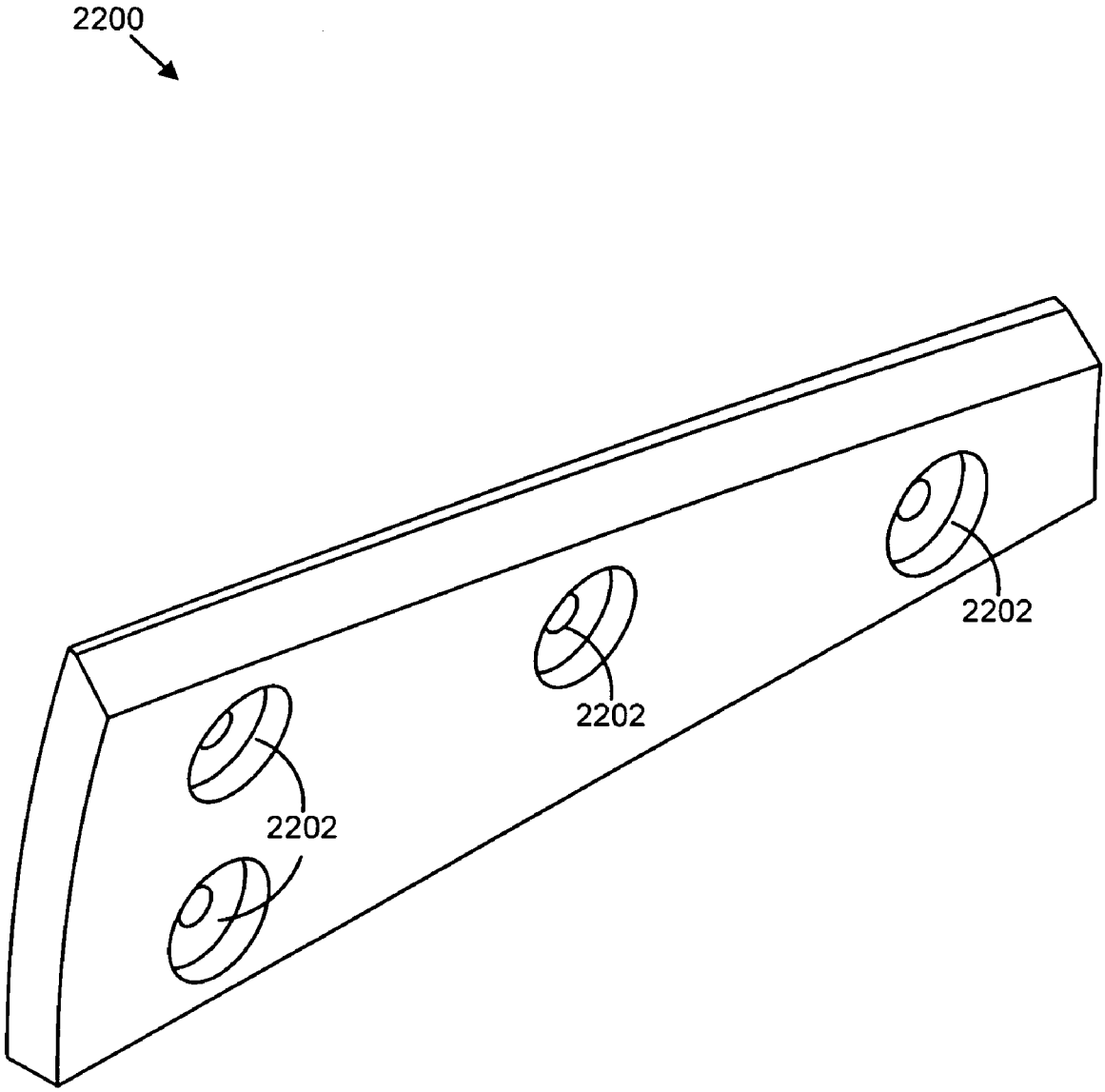
FIG. 7 is a perspective view diagram illustrating an alternative embodiment of a diverter in accordance with the present embodiment.

FIG. 7 is a perspective view diagram illustrating an alternative embodiment of a diverter 700 in accordance with the present embodiment. In one embodiment the diverter 700 is configured as a solid wedge shaped member formed of a semi-rigid material. The diverter 700 is formed having a shape configured to interface with the interior surface of the shroud 204, and flush mount with the shroud 204. The diverter 700 may be implemented with a plurality of holes 702 configured to receive fasteners for coupling the diverter 702 to the shroud 204. In one embodiment, the fasteners comprise rivets, screws, spot welds, etc. The diverter 702 is configured with a shape selected to optimally direct water to form a vortex as the water exits the shroud 204 as described above with reference to FIGS. 6*a* and 6*b*.

Figure 8:
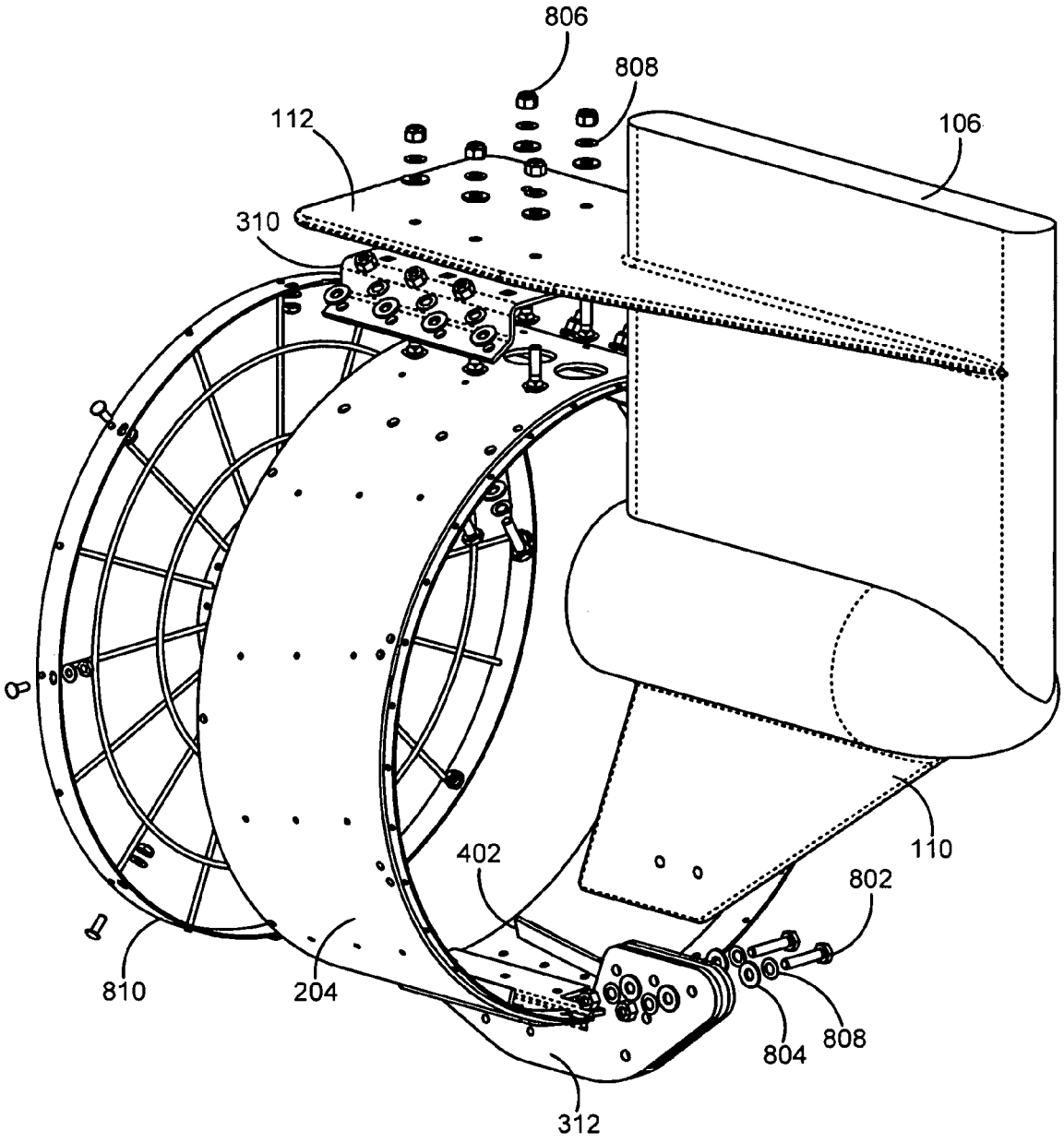
FIG. 8 is an exploded perspective view diagram illustrating another embodiment of a system for moving a marine vehicle in accordance with the present invention.

FIG. 8 is an exploded perspective view diagram illustrating another embodiment of a system 200 for moving a marine vehicle in accordance with the present invention. In one embodiment, the shroud 204 is configured to couple to the lower unit 106 of the marine vehicle using the above described mounting plate 310 and skeg coupler 312. The shroud 204, the mounting plate 310, and skeg coupler 312 may be connected using fasteners. In the depicted embodiment, the fastener may comprise common fastening components such as a bolt 802, washer 804, and nut 806.

In a further embodiment, the fastener may include a cupped washer 808. The cupped washer 808 is configured having a slight conical shape which gives the cupped washer 808 spring-like properties. The cupped washer 808, also referred to as a "spring washer," provides a pre-load or flexible quality to the fastener for absorbing vibrations and impacts. One example of a cupped washer 808 suitable for use with the present invention is a Belleville Washer that may be obtained from hardware and automotive stores.

The addition of a cupped washer 808 to the fasteners where the shroud 204 connects to the cavitation plate 112 and the skeg 110 causes each fastener to function in a manner similar to a shock absorber. This greatly reduces and nearly eliminates vibrations of harmonics in the shroud 204. In one embodiment, a cupped washer 808 suitable for use with the present invention is configured with a 150 lb. rating. In an alternative embodiment, the shroud 204, the mounting plate 310, and the skeg coupler 312 may be welded together. In a further embodiment, the shroud 204, the mounting plate 310, and the skeg coupler 312 may be formed as a single unitary device.

The system 200 may also include a web guard 810 coupled with the second opening of the shroud 204. The web guard 810 is configured to allow the substantial free flow of water as the water exits the shroud 204 while preventing human and animal contact with the propeller. The web guard 810 may likewise be coupled with the shroud 204 using fasteners having cupped washers 808. Alternatively, flat washers may be used. The web guard 810 will be discussed in greater detail below with reference to FIG. 9.

Figure 9:
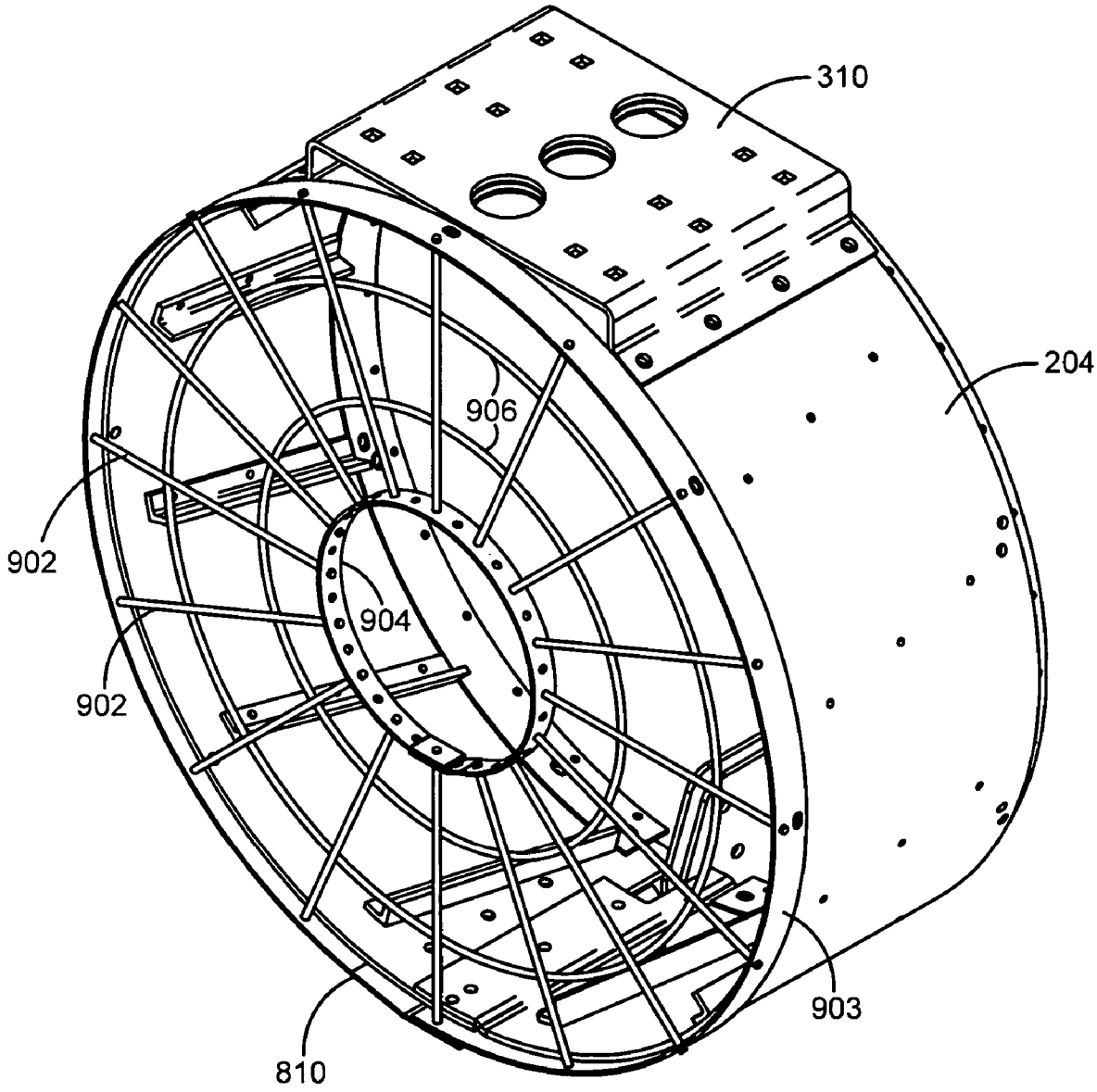
FIG. 9 is a perspective view diagram illustrating one embodiment of the shroud 204 having a web guard in accordance with the present invention.

FIG. 9 is a perspective view diagram illustrating one embodiment of the shroud 204 having a web guard 810 in accordance with the present invention. In one embodiment, the web guard 810 may comprise a plurality of support braces 902 extending outward radially from an inner support ring 904 to an outer support ring 903. A series of concentric rings 906 may be connected with the support braces 902 to further increase the strength of the web guard 810.

The components 902, 903, 904 of the web guard 810 may be formed substantially of one material such as metal or a rigid plastic. In one embodiment, the web guard 810 is formed of stainless steel. The intersections of the support braces 902 and the concentric rings 906 may be reinforced by welding or other joining means such as an adhesive or fasteners. Likewise, the support braces 902 may be welded or bolted on one end with the inner support ring 904 and the other end with the outer support ring 903.

Figure 10A:
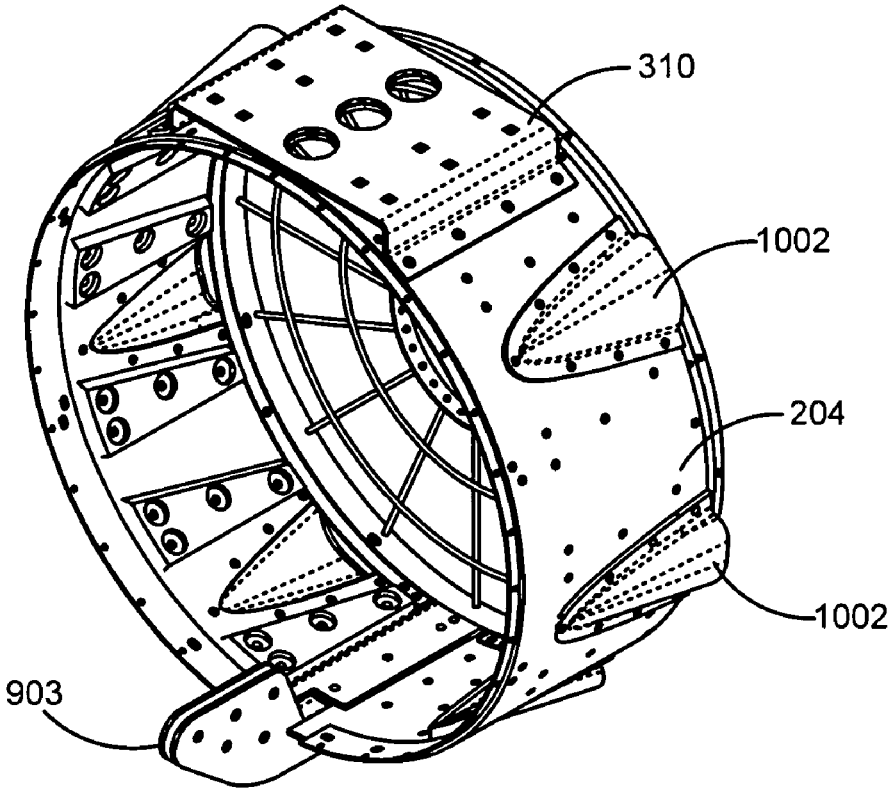
FIG. 10*a* is a perspective view diagram illustrating one embodiment of a shroud having a plurality of flutes in accordance with the present invention.

FIG. 10*a* is a perspective view diagram illustrating one embodiment of a shroud 204 having a plurality of flutes 1002 in accordance with the present invention. As used herein, the term "flute" refers to a channel configured to direct water in a specific direction. In one embodiment, the shroud 204 may be formed with a plurality of openings or cutouts configured to relieve pressure generated by the propeller inside the shroud 204 and direct the pressure aft, or in other words to direct the pressure in such a way as to help propel the marine vehicle.

The openings (see FIG. 10*b*) may be covered by the flute 1002 in order to direct water to form a vortex. The flutes 1002 may be formed of metal and configured with a "twist," or asymmetric cross-section, to help in the formation of the vortex.

Figure 10B:
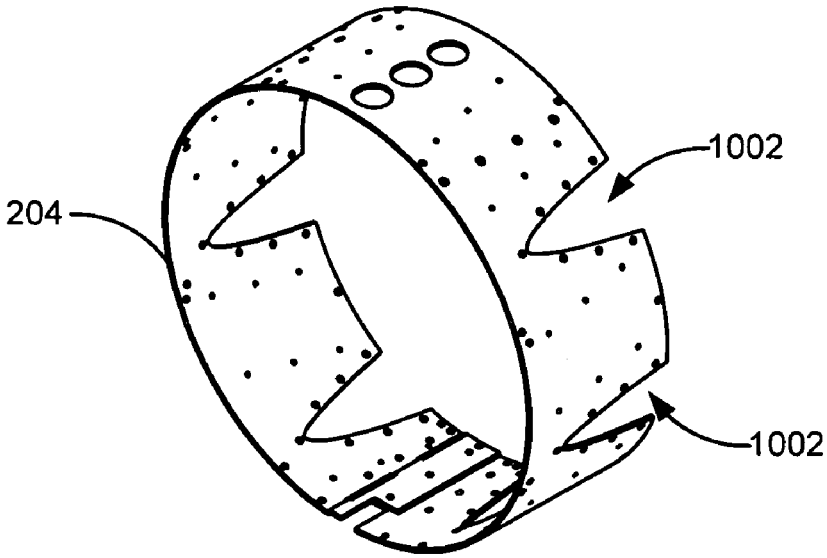
FIG. 10*b* is a perspective view diagram illustrating one embodiment of the shroud having openings for relieving pressure within the shroud in accordance with the present invention.

FIG. 10*b* is a perspective view diagram illustrating one embodiment of the shroud 204 having openings 1004 for relieving pressure within the shroud 204 in accordance with the present invention. The shroud 204 may be formed from a single sheet of material in an elongated, substantially rectangular shape and then bent into a tubular form as depicted. The shroud 204 may be formed by many different methods of manufacture such as, but not limited to, injection molding, pressing, rolling, casting, etc.

Figure 11A:
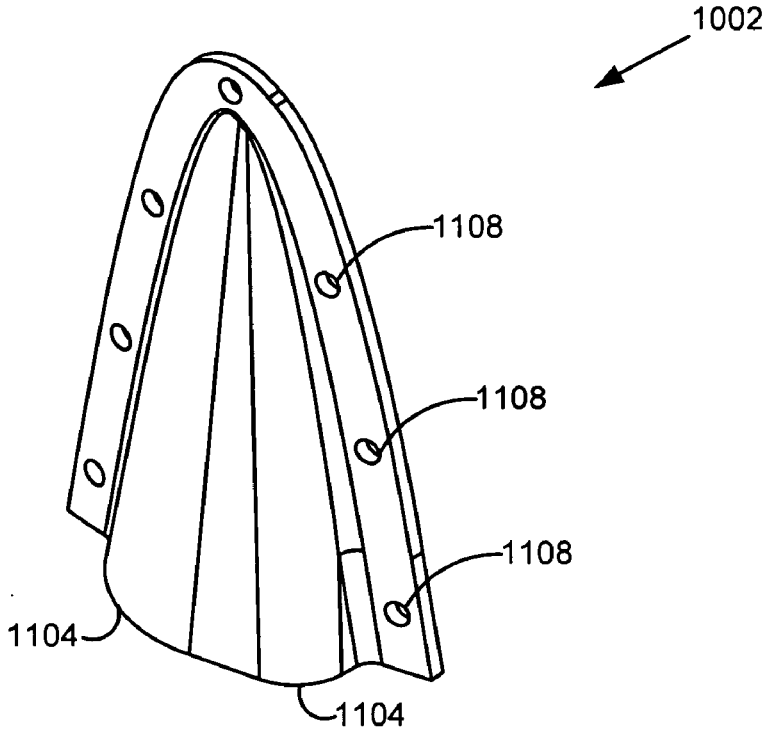
FIG. 11*a* is a perspective view diagram illustrating a pressed flute suitable for use with the shroud in accordance with the present invention.
Figure 11B:
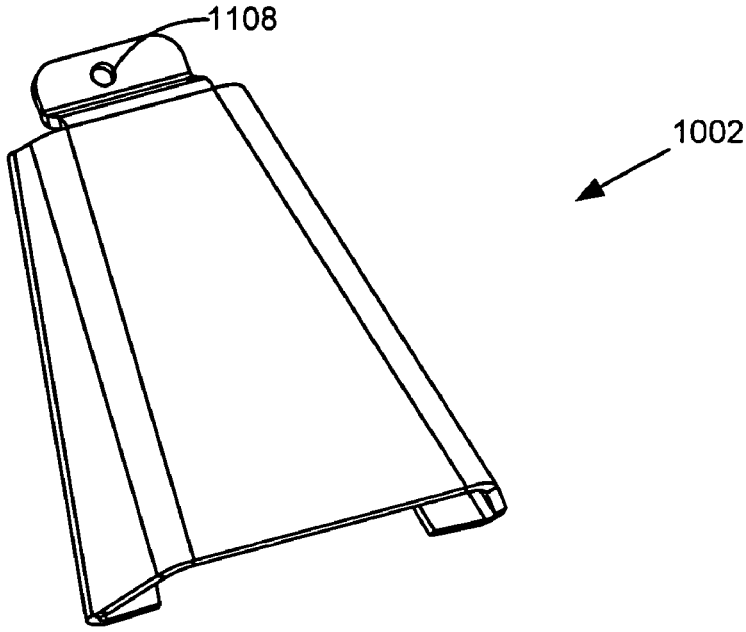
FIG. 11*b* is a perspective view diagram illustrating a sheet metal flute suitable for use with the shroud in accordance with the present invention.

FIGS. 11*a* and 11*b* are perspective view diagrams illustrating flutes 1002, 1102 suitable for use with the shroud 204 in accordance with the present invention. The flute 1002 may be formed of metal or plastic and pressed with a shape configured to direct water to form a vortex. For example, the flute 1002 may be formed with a sharp corner 1104 on one side of the flute and a more rounded corner 1106. Such a configuration would cause more water to flow out of the "taller" corner and cause an uneven flow through the flute that leads to the enhancement of the vortex.

The flutes 1002, 1102 may be formed with a plurality of holes 1108 for connecting the flutes 1002, 1102 with the shroud 204. Appropriate fastening devices include, but are not limited to, rivets, bolts, screws, etc. In a further embodiment, the flute 1102 of FIG. 11*b* may be formed of sheet metal and bent to form the flute 1102. Such a configuration is cheaper to manufacture because there is no need for the stamping tools required to form the flute 1002 of FIG. 11*a*.

Figure 12:
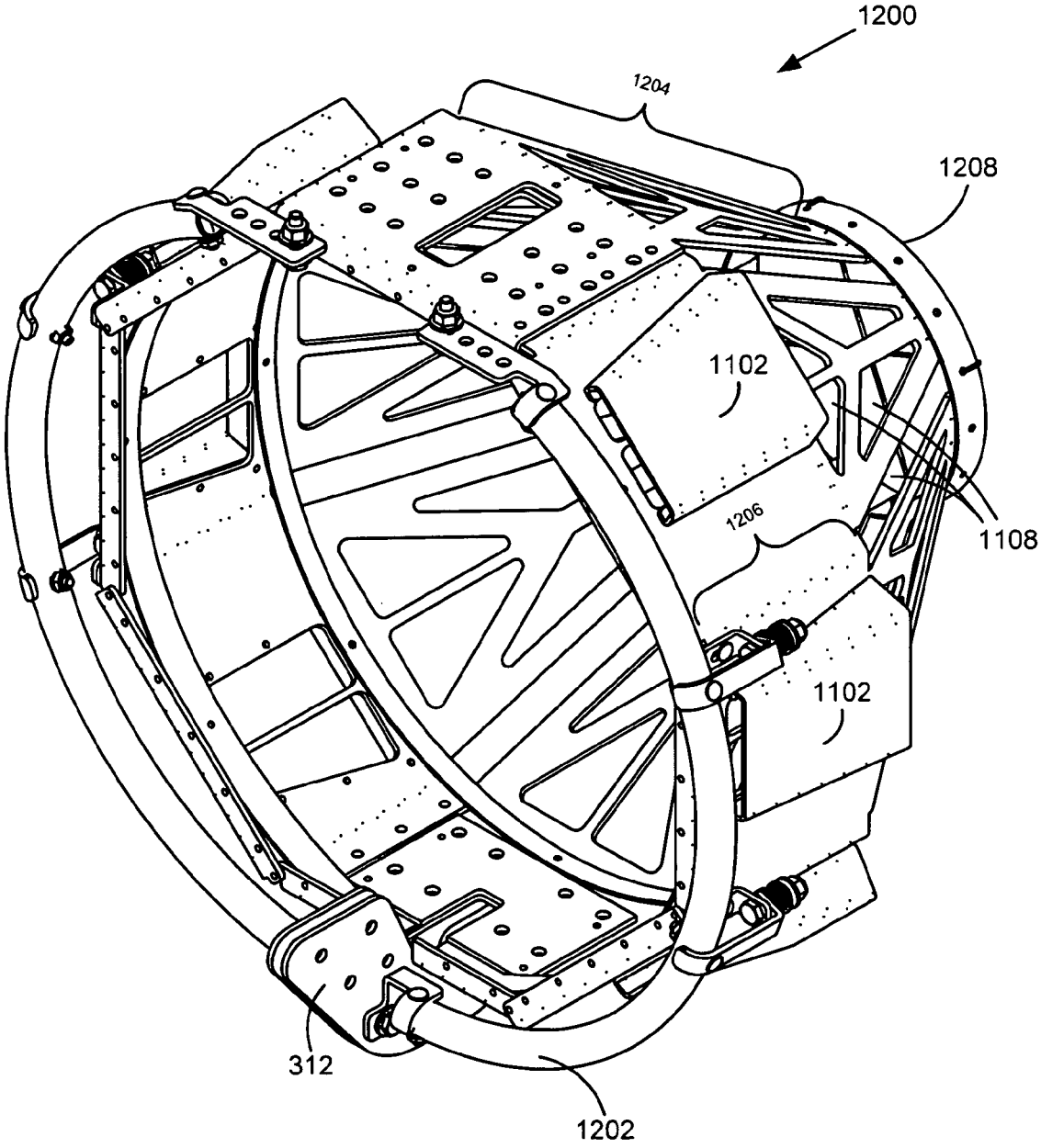
FIG. 12 is a perspective view diagram illustrating one embodiment of a shroud having a bumper guard in accordance with the present invention.

FIG. 12 is a perspective view diagram illustrating one embodiment of a shroud 1400 having a bumper guard 1202 in accordance with the present invention. In one embodiment, the shroud 1200 may be configured with a conical portion 1204 integrally formed with a substantially tubular portion 1206 and extending to a support ring 1208. The conical portion 1204 may comprise a plurality of cut-out portions 1210 configured to allow the egress of water from the shroud 1200. The conical portion 1204 together with the cut-out portions 1210 allow the substantial free flow of water as the water exits the shroud 1200 while preventing human, animal, or marine contact with the propeller. In a further embodiment, a web guard (not shown) may be connected with the conical portion 1204.

The bumper guard 1202 may be coupled with the first opening of the shroud 1200. The bumper guard may be formed substantially of metal or plastic tubing. The bumper guard 1202 prevents cutting of humans, animals, and marine life by the sharp "leading" edge of the shroud 1200. The bumper guard 1202 will be discussed in greater detail below with reference to FIGS. 14*a* and 14*b*.

Figure 13:
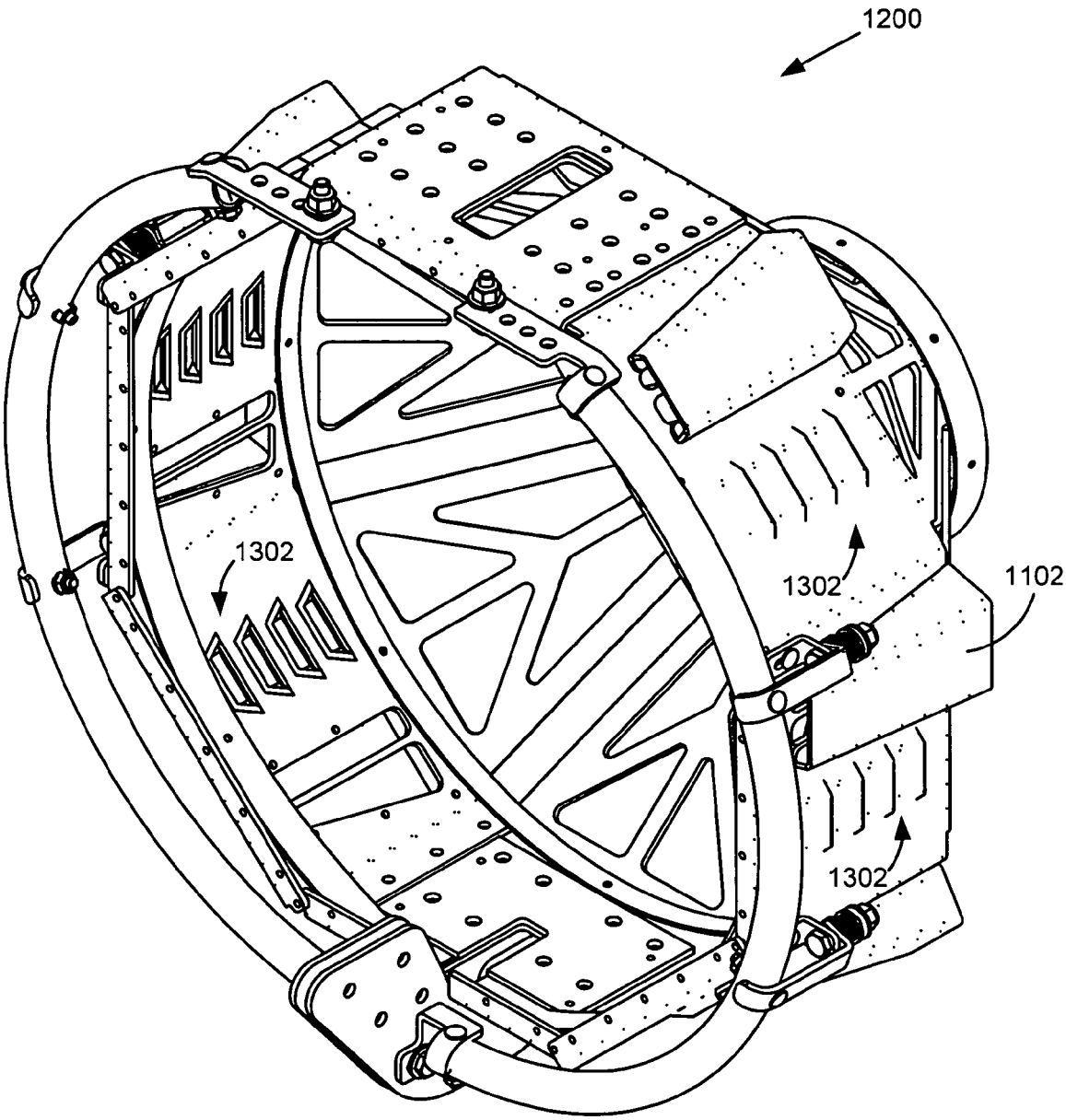
FIG. 13 is a perspective view diagram illustrating another embodiment of the shroud 1200 having a plurality of louvers in accordance with the present invention.

FIG. 13 is a perspective view diagram illustrating another embodiment of the shroud 1200 having a plurality of louvers 1302 in accordance with the present invention. As used herein, the term "louvers" refers to slotted openings placed in the shroud for venting water from the interior of the shroud to the exterior. Utilizing louvers 1302 allows for the use of smaller flutes 1102, thereby potentially lowering the cost of manufacture. Additionally, the flutes 1102 may be replaced with any channel forming device that directs water to form a vortex, for example the flute 1002 of FIG. 11*a*. The louvers 1302 are configured to vent water and therefore release a pressure buildup within the shroud 1200.

Figure 14:
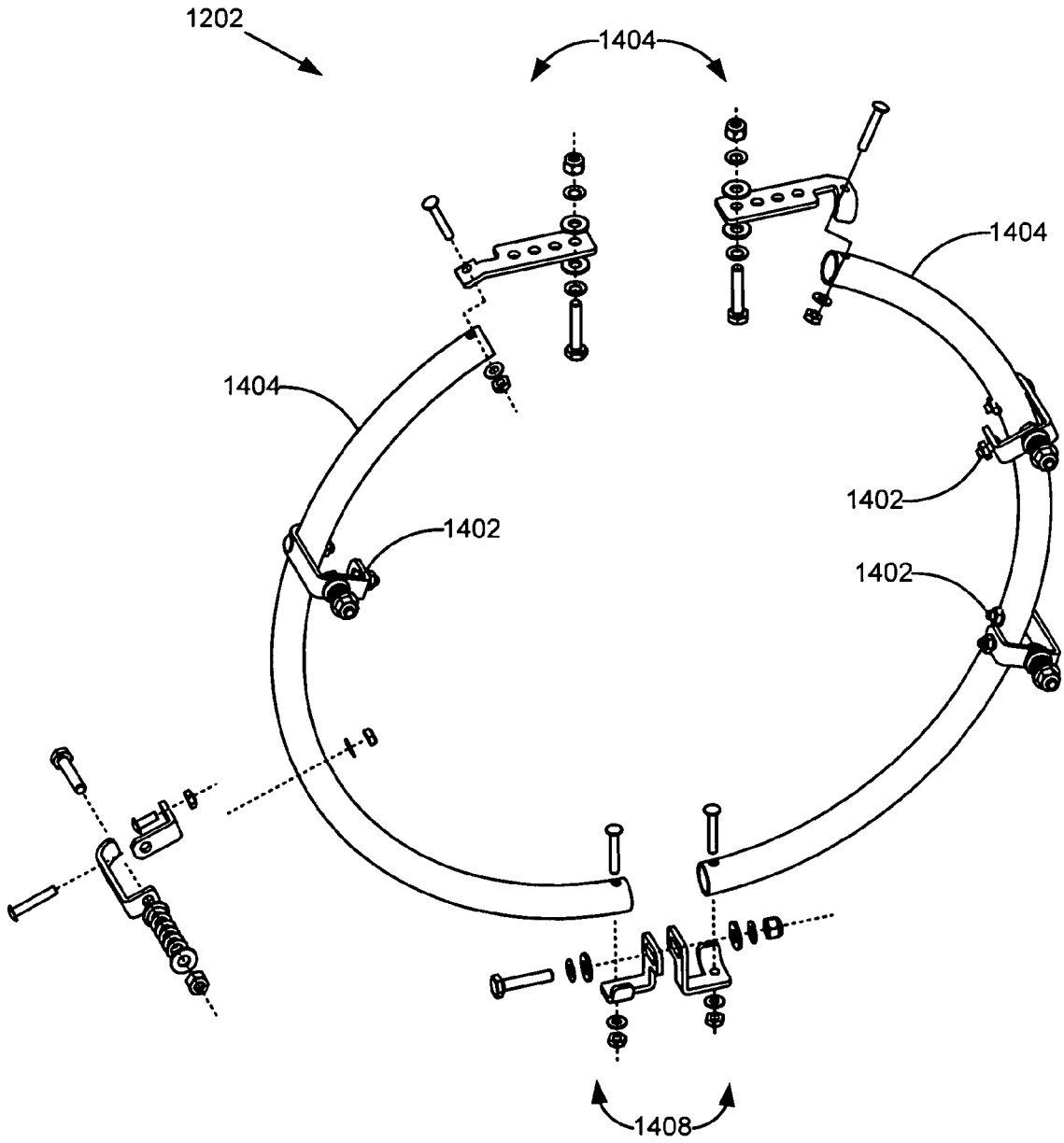
FIG. 14 is an exploded view diagram illustrating one embodiment of the bumper guard in accordance with the present invention.

FIG. 14 is an exploded view diagram illustrating one embodiment of the bumper guard in accordance with the present invention. In one embodiment, the bumper guard 1202 comprises a plurality of spring loaded mounts 1402 configured to absorb impacts. The spring loaded mounts 1402 will be discussed in greater detail below with reference to FIG. 15. The bumper guard 1202, as depicted, comprises a plurality of semi-circular tube portions 1404. The semi-circular tube portions 1404 together form a substantially circular guard that protects the shroud 1200 and also reduces injuries inflicted on human, animal, and marine life in the event of contact with the shroud 1200.

The bumper guard 1202 comprises upper mounts 1406 configured to couple the bumper guard 1202 with the shroud, and lower mounts 1408 that connect the bumper guard 1202 with the skeg coupler 312.

Figure 15A:
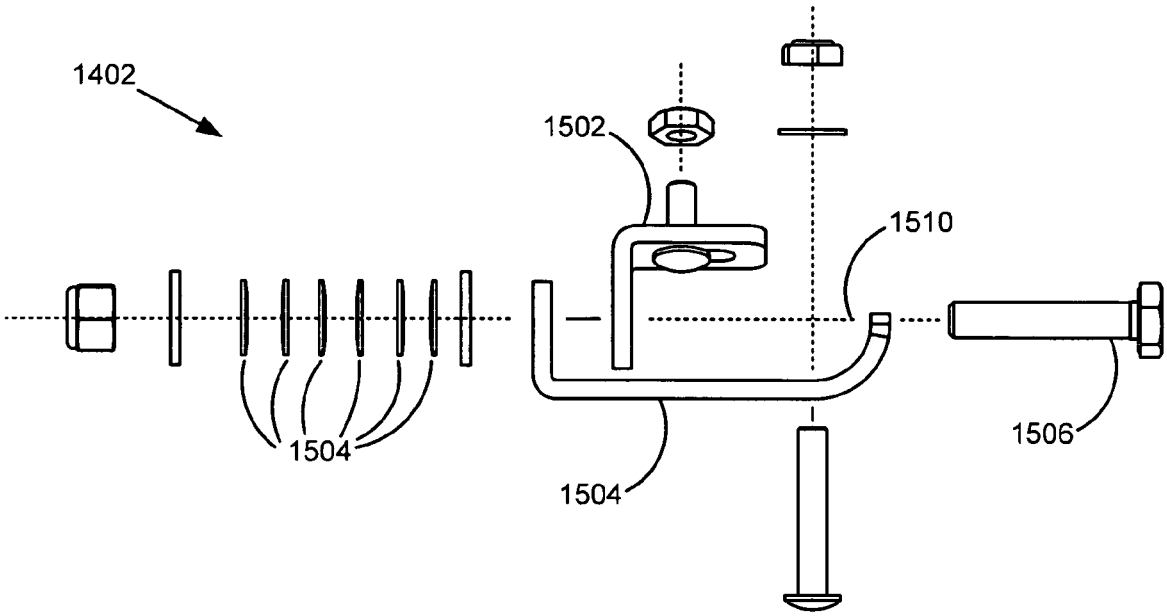
FIG. 15*a* is an exploded view diagram illustrating one embodiment of spring loaded mounts in accordance with the present invention.

FIG. 15*a* is an exploded view diagram illustrating one embodiment of spring loaded mounts 1402 in accordance with the present invention. In one embodiment, the spring loaded mounts (hereinafter "mounts") 1402 comprise a shroud bracket 1502, a tube bracket 1504, a plurality of fasteners 1506, and a plurality of cupped washers 1508. The shroud bracket 1502 may be fixedly coupled with the shroud using a fastener such as a nut and bolt, rivet, or the like. Similarly the tube bracket 1504 is coupled with the tube portion 1404.

A fastener 1506 connects the shroud bracket 1502 to the tube bracket 1504. In one embodiment, the fastener 1506 passes through a hole (not shown) in the shroud bracket 1502 and a hole (not shown) in the tube bracket 1504 in a direction indicated by the dashed line 1510. Cupped washers 1508 may then be placed on the fastener 1506 to provide a spring-loaded bracket capable of absorbing impacts and vibrations.

The cupped washers 1508 may be placed back to back and front to front, as depicted, in order to form a bellows-type spring. The cupped washers 1508 may each be of the same spring rate, 150 lbs for example, or alternatively of different spring rates in order to attain a specific total spring rate for the mount 1402. In one embodiment, the total spring rate for the mount 1402 is in the range of between about 400 and 1200 lbs.

Figure 15B:
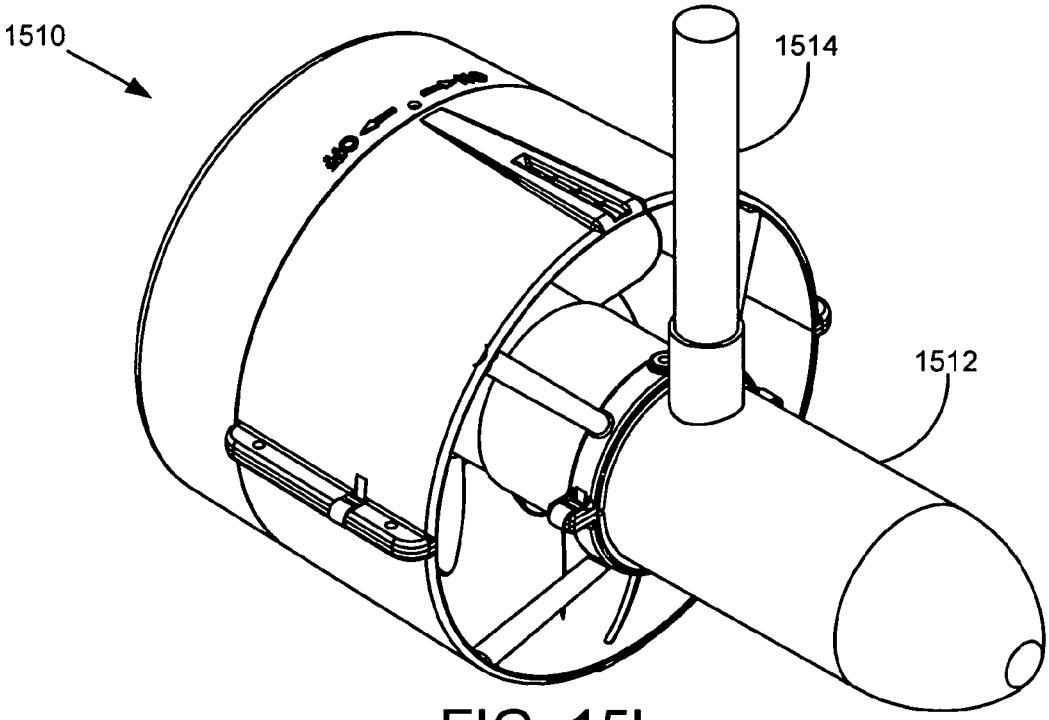
FIG. 15*b* is a perspective view diagram illustrating one embodiment of a trolling motor shroud in accordance with the present invention.

FIG. 15*b* is a perspective view diagram illustrating one embodiment of a trolling motor shroud 1510 in accordance with the present invention. Trolling motors are typically electronic motors contained within a motor housing 1512 and coupled with a down shaft 1514 which subsequently is connected to a marine vehicle. The trolling motor shroud 1510 is configured to mount to the motor housing 1512 of the trolling motor. The trolling motor shroud 1510 and accompanying impeller will be discussed in greater detail below with reference to FIGS. 16–18.

Figure 16:
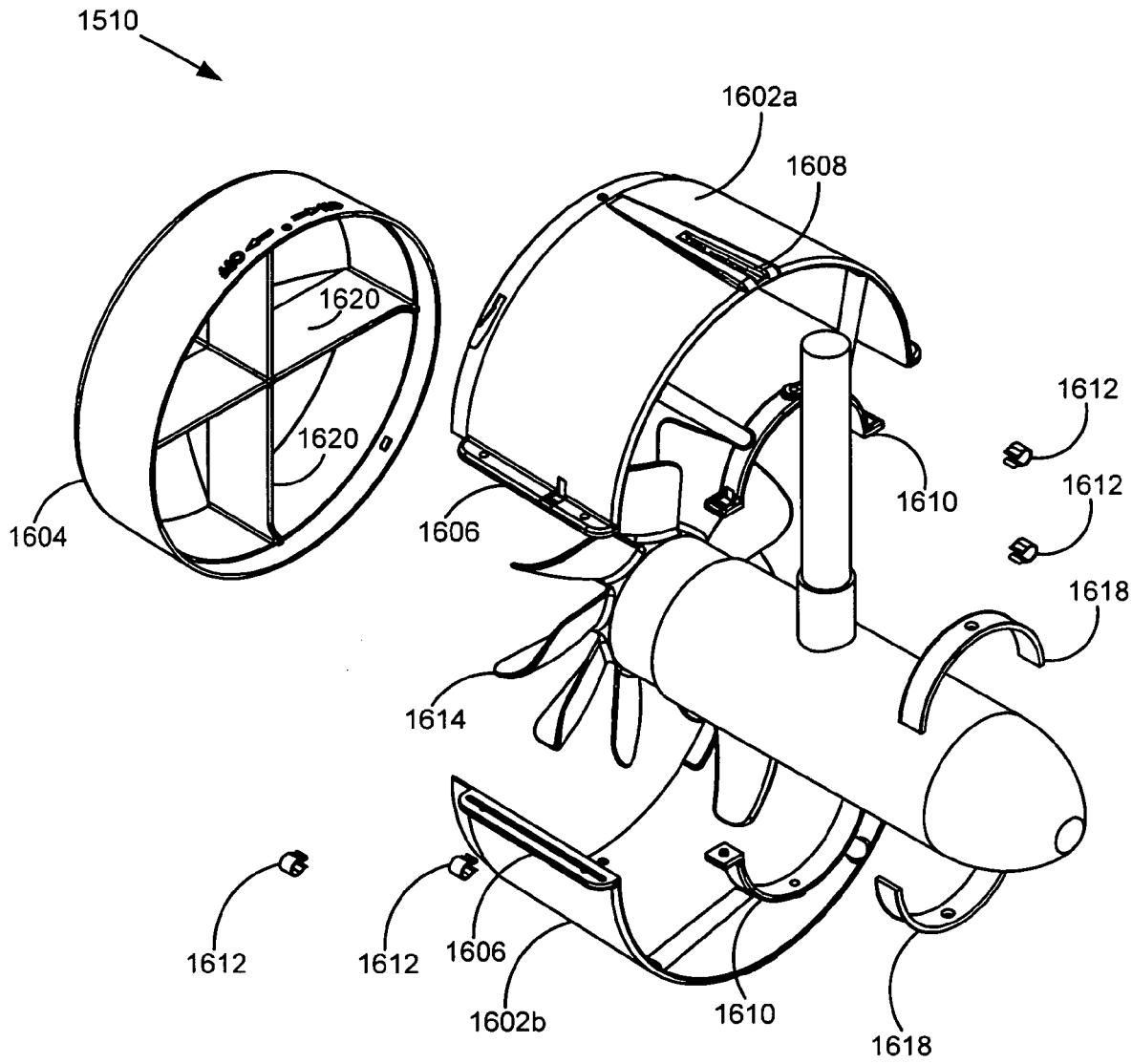
FIG. 16 is an exploded view diagram illustrating one embodiment of the trolling motor shroud in accordance with the present invention.

FIG. 16 is an exploded view diagram illustrating one embodiment of the trolling motor shroud 1510 in accordance with the present invention. In one embodiment the trolling motor shroud (hereinafter "TMS") 1510 is formed of two semi-circular portions 1602 and an annular portion 1604. Each of the semi-circular portions 1602 comprises flanges 1606 cut-out portion 1608, and a semi-circular mounting bracket 1610.

The flanges 1606 of the upper semi-circular portion 1602*a* are configured to engage the flanges 1606 of the lower semi-circular portion 1602*b*. Clips 1612 may couple the upper and lower semi-circular portions to substantially surround an impeller 1614. The mounting bracket 1610 is configured with a diameter for engaging the motor housing 1512. The upper and lower mounting brackets 1610 may be fastened together in order to securely engage the trolling motor housing 1512.

The cut-out portion 1608 may be removed in order to accommodate a skeg 1616 of the trolling motor. The cut-out portion 1608 is configured with multiple cut-out regions such that skegs 1616 of varying sizes may be inserted into the cut-out portion. As depicted, the upper semi-circular portion 1602*a* also has a cut-out portion 1608 due to the nature of the manufacturing process of the TMS 1510. In order to reduce manufacturing costs, identical upper and lower semi-circular portions 1510 may be used. Subsequently, the upper semi-circular portion 1602*a* may have a cut-out portion 1608 that is not used.

One or more shims 1618 may be installed between each of the motor housing 1512 and the upper or lower mounting brackets 1610 in order to adapt and or modify the TMS 1510 for use on different diameter motor housings 1512. The annular portion 1604 may comprise support braces 1620 configured for supporting the structural integrity of the annular portion 1604 and ensuring the cylindrical stability of the TMS 1510 under trolling motor pressure. Furthermore, the support braces 1620 may act as stabilizing vanes thereby further increasing the efficiency of the TMS 1510. The annular portion 1604 is configured to "thread" onto the aft end of the semi-circular portions 1602 in a manner similar to a bottle lid, thereby forming the TMS 1510 as depicted in FIG. 15*b*.

Figure 17:
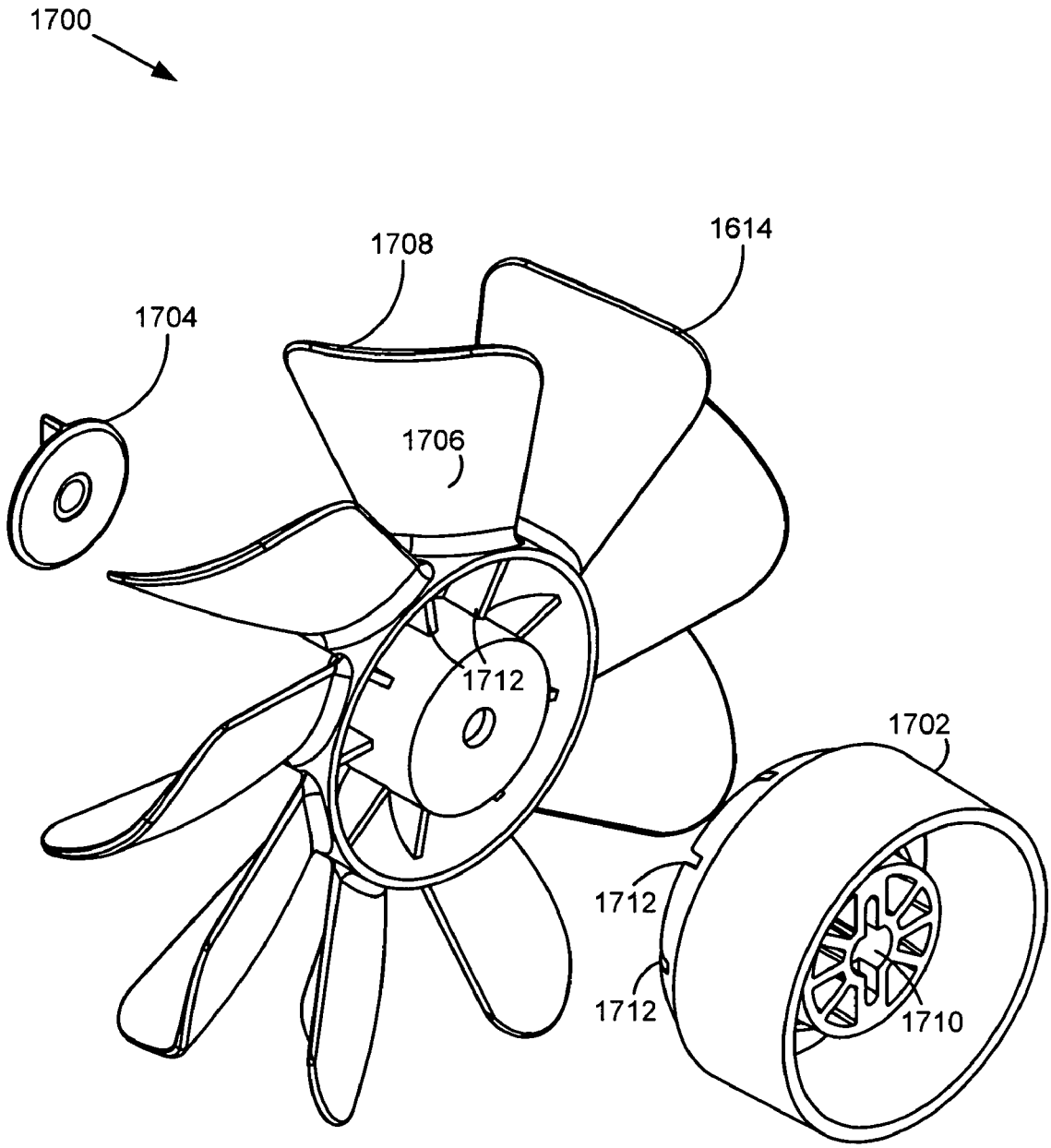
FIG. 17 is an exploded view diagram of one embodiment of an impeller assembly in accordance with the present invention.

FIG. 17 is an exploded view diagram of one embodiment of an impeller assembly 1700 in accordance with the present invention. The impeller assembly 1700, in one embodiment, comprises the impeller 1614, a keyway specific hub 1702 and a wingnut 1704. The impeller comprises a plurality of cupped blades 1706, each blade 1706 having a flat tip 1708 which, together with the interior surface of the TMS 1510, act in a manner similar to a turbine. Such a configuration greatly increases performance because energy is not lost from the tips of the impeller like a common trolling motor propeller. However, the TMS 1510 may be used in conjunction with common trolling motor propellers.

The hub 1702 is configured with a keyway specific slot for engaging the drive shaft of different trolling motors. Examples of trolling motors suitable for use with the present invention include, but are not limited to, trolling motors manufactured by Minn Kota of Fargo, N. Dak., and Motorguide of Tulsa, Okla. In a further embodiment, the hub 1702 includes a plurality of slots 1712 configured to engage the webs 1714 of the impeller 1614 in order to transfer the driving force of the trolling motor to the impeller 1614. The wingnut 1704 secures the impeller and the hub 1702 to the drive shaft and subsequently the motor housing 1512.

Figure 18A:
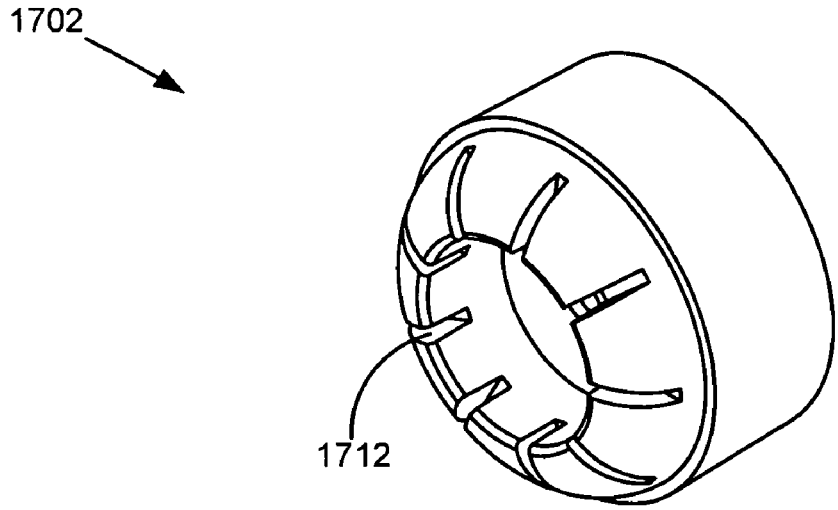
FIG. 18*a* is a perspective view diagram illustrating one embodiment of the hub in accordance with the present invention.

FIG. 18*a* is a perspective view diagram illustrating one embodiment of the hub 1702 in accordance with the present invention. As described above, the hub 1702 includes a plurality of slots 1712 configured to engage the webs 1714 of the impeller 1614. The impeller 1614, the hub 1702 and the wingnut 1704 may be formed from substantially one material. In one embodiment, the impeller 1614, the hub 1702, and the wingnut 1704 may be formed of a rigid plastic including, but not limited to, nylon. Alternatively, the impeller system 1700 may be formed of a metal.

Figure 18B:
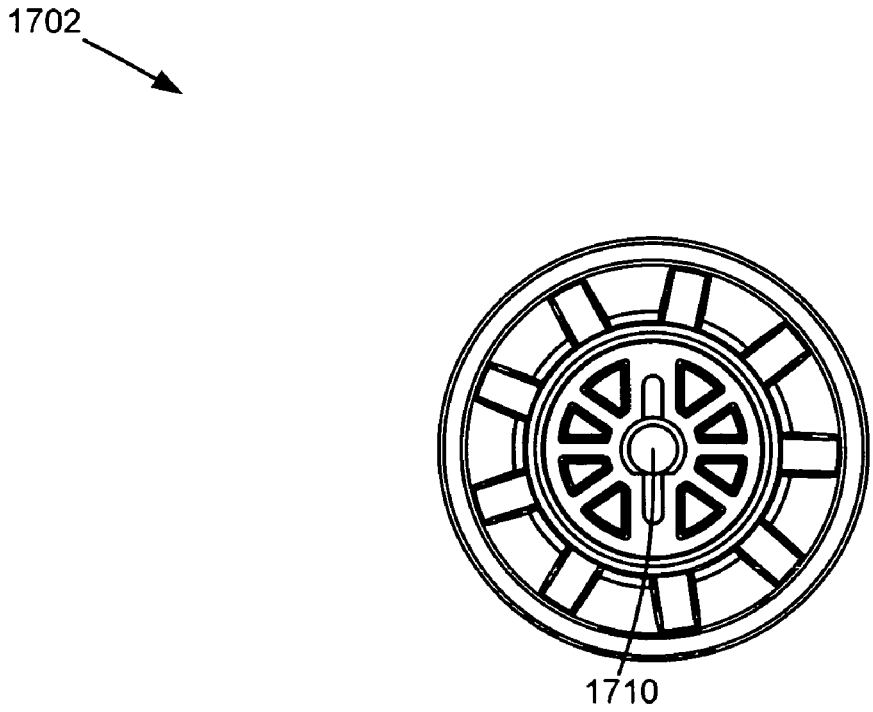
FIG. 18*b* is a schematic block diagram illustrating another embodiment of the hub in accordance with the present invention.

FIG. 18*b* is a schematic block diagram illustrating another embodiment of the hub 1702 in accordance with the present invention. As depicted the keyway 1710 may be configured with a flat surface corresponding with a flat surface on a driveshaft (not shown). Alternatively, the keyway 1710 may be configured according to the shape of the driveshaft. The shape of the driveshaft is generally determined by the manufacturer of the trolling motor. Advantageously, the impeller system 1700 may be adapted to any trolling motor by simply changing hubs 1702 to match the driveshaft of the trolling motor.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A trolling motor shroud comprising:

first and second semi-circular portions configured to connect together to substantially enclose a hydro-drive device;

a semi-circular bracket coupled to each semi-circular portion, the semi-circular brackets together capable of fixedly coupling the first and second semi-circular portions to a trolling motor housing; and an annular portion configured to couple to an aft opening formed by the first and second semi-circular portions.

2. The trolling motor shroud of claim 1, wherein each of the first and second semi-circular portions comprises a semi-annular surface having a plurality of flanges extending outward laterally therefrom, each flange configured to engage a surface of a flange of an opposing semi-circular portion.

3. The trolling motor shroud of claim 2, further comprising a plurality of clips configured to securely engage a plurality of opposing flanges and maintain the position of the flanges relative to one another.

4. The trolling motor shroud of claim 1, wherein the annular portion further comprises support braces configured to stabilize the flow of water exiting the trolling motor shroud.

5. The trolling motor shroud of claim 1, wherein the first and second semi-circular portions are identical.

6. The trolling motor shroud of claim 1, wherein the first and second semi-circular portions each comprise a cut-out portion for receiving a skeg.

7. The trolling motor shroud of claim 6, wherein the cut-out portion comprises a plurality of cut-out regions configured to receive skegs of varying sizes.

8. The trolling motor shroud of claim 1, wherein the annular portion is configured to couple to the aft opening by screwing onto the first and second semi-circular portions and to secure the first and second semi-circular portions together.

9. The trolling motor shroud of claim 1, further comprising at least one shim for decreasing the diameter of the semi-circular bracket in order to engage smaller diameter trolling motor housings.

10. A trolling motor shroud comprising:

a trolling motor;

a hydro-drive device coupled to the trolling motor;

first and second semi-circular portions configured to connect together to substantially enclose a hydro-drive device;

a semi-circular bracket coupled to each semi-circular portion, the semi-circular brackets together capable of fixedly coupling the first and second semi-circular portions to a trolling motor housing; and an annular portion configured to couple to an aft opening formed by the first and second semi-circular portions.

11. The trolling motor shroud of claim 10, wherein each of the first and second semi-circular portions comprises a semi-annular surface having a plurality of flanges extending outward laterally therefrom, each flange configured to engage a surface of a flange of an opposing semi-circular portion.

12. The trolling motor shroud of claim 11, further comprising a plurality of clips configured to securely engage a plurality of opposing flanges and maintain the position of the flanges relative to one another.

13. The trolling motor shroud of claim 10, wherein the annular portion further comprises support braces configured to stabilize the flow of water exiting the trolling motor shroud.

14. The trolling motor shroud of claim 10, wherein the first and second semi-circular portions are identical.

15. The trolling motor shroud of claim 10, wherein the first and second semi-circular portions each comprise a cut-out portion for receiving a skeg.

16. The trolling motor shroud of claim 15, wherein the cut-out portion comprises a plurality of cut-out regions configured to receive skegs of varying sizes.

17. The trolling motor shroud of claim 10, wherein the annular portion is configured to couple to the aft opening by screwing onto the first and second semi-circular portions and to partially secure the first and second semi-circular portions.

18. The trolling motor shroud of claim 10, further comprising at least one shim for decreasing the diameter of the semi-circular bracket in order to engage smaller diameter trolling motor housings.

19. A trolling motor shroud comprising:

a trolling motor;

a hydro-drive device coupled to the trolling motor;

first and second semi-circular portions configured to connect together to substantially enclose a hydro-drive device;

a semi-circular bracket coupled to each semi-circular portion, the semi-circular brackets together capable of fixedly coupling the first and second semi-circular portions to a trolling motor housing;

an annular portion configured to couple to an aft opening formed by the first and second semi-circular portions;

wherein each of the first and second semi-circular portions comprises a semi-annular surface having a plurality of flanges extending outward laterally therefrom, each flange configured to engage a surface of a flange of an opposing semi-circular portion;

a plurality of clips configured to securely engage a plurality of opposing flanges and maintain the position of the flanges relative to one another;

wherein the first and second semi-circular portions are identical;

wherein the first and second semi-circular portions each comprise a cut-out portion for receiving a skeg;

wherein the annular portion is configured to couple to the aft opening by screwing onto the first and second semi-circular portions and to partially secure the first and second semi-circular portions; and at least one shim for decreasing the diameter of the semi-circular bracket in order to engage smaller diameter trolling motor housings.

* * * * *

UNITED STATES PATENT AND TRADEMARK OFFICE

CERTIFICATE OF CORRECTION

PATENT NO. : 7,229,331 B2
APPLICATION NO. : 11/337436
DATED : June 12, 2007
INVENTOR(S) : George I. Norman It is certified that error appears in the above-identified patent and that said Letters Patent is hereby corrected as shown below:

Column 5

Line 29 reads "for the egress of" Should read -- for the egress of water. --

Signed and Sealed this

Twenty-eighth Day of August, 2007

JON W. DUDAS
*Director of the United States Patent and Trademark Office*